US006494732B2

(12) United States Patent
Kashiyama et al.

(10) Patent No.: US 6,494,732 B2
(45) Date of Patent: Dec. 17, 2002

(54) CONNECTOR FITTING STRUCTURE

(75) Inventors: Motohisa Kashiyama, Shizuoka (JP); Takanori Yamawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/791,868

(22) Filed: Feb. 26, 2001

(65) Prior Publication Data

US 2001/0023154 A1 Sep. 20, 2001

(30) Foreign Application Priority Data

Feb. 25, 2000 (JP) ..... 2000-49746

(51) Int. Cl.[7] ..... H01R 13/627
(52) U.S. Cl. ..... 439/352; 439/160; 439/489
(58) Field of Search ..... 439/352, 159, 439/160, 489

(56) References Cited

U.S. PATENT DOCUMENTS 6,102,726 A * 8/2000 Tsuji et al. ..... 439/352
6,241,547 B1 * 6/2001 Fukuda ..... 439/352

FOREIGN PATENT DOCUMENTS

| | | |
|---|---|---|
| JP | 11-111390 | 4/1999 |
| JP | 11-149959 | 6/1999 |

* cited by examiner

*Primary Examiner*—Gary Paumen
*Assistant Examiner*—James R. Harvey
(74) *Attorney, Agent, or Firm*—Sughrue Mion, PLLC

(57) ABSTRACT

In a connector fitting structure, one connector includes an inner housing, having lock arms, and an outer housing having a slider slidably mounted therein. The other connector includes a housing, and engagement projections for abutment against the slider and for respectively elastically deforming the lock arms are formed on this housing. Second retaining portions, which are engageable respectively with first retaining portions formed on the one connector, are formed respectively on engagement arms 16 provided at a second slide member of the slider. Stoppers, which prevent the cancellation of the engagement of the first retaining portions with the second retaining portions before starting the connector fitting operation, are formed on a first slide member of the slider.

7 Claims, 11 Drawing Sheets

CONNECTOR FITTING STRUCTURE

BACKGROUND OF THE INVENTION

1. Field of the Invention

This invention relates to a connector fitting structure in which a pair of male and female connectors are fittingly connected together.

The present application is based on Japanese Patent Application No. 2000-49746, which is incorporated herein by reference.

2. Description of the Related Art

Usually, many electronic equipments are mounted on a vehicle such as an automobile, and various cables for supplying electric power to these equipments and for controlling these equipments, as well as male and female connectors for connecting these cables, have been extensively used. Such male and female connectors have durability and a waterproof function so as to be suitably used in a severe environment, in which vibrations and submergence are encountered, and besides the male and female connectors are so constructed that a wire harness or the like can be easily attached to and detached from the connectors during an assembling process and at the time of maintenance.

One example of conventional connector fitting structures will be described with reference to FIGS. 8 to 11. As shown in FIG. 8, a male connector (one connector) 60 of the connector fitting structure 51 includes an inner housing 62, which has terminal receiving chambers for respectively receiving a predetermined number of socket contacts, and is open to the front side thereof, and an outer housing 61 covering the outer periphery of the inner housing 62.

The outer housing 61 includes a slider receiving portion 63 for receiving a slider 70, and guide grooves 65 for respectively guiding opposite side portions of the slider 70 are formed respectively at opposite side portions of the slider receiving portion 63, that is, in inner surfaces of opposite side walls of the outer housing 61. Within the slider receiving portion 63, lock arms 66, each having a free end (front end in a connector fitting direction), are formed integrally on the inner housing 62.

A housing lock 68 for retaining engagement with an engagement projection 93 on a female connector (the other connector) 90 is formed on an upper surface of each lock arm 66 at the distal end thereof. An insertion space 66*a* for allowing the insertion of a pressing rib 92 on the female connector 90 is formed between the distal end portions of the lock arms 66. A pressing portion 69, which is pressed when canceling the fitting connection, is formed on central portions of the lock arms 66.

A pair of retaining arms 67 for temporarily preventing the rearward movement of the slider 70 are provided respectively in opposite side spaces 63*a* of the slider receiving portion 63 disposed at a rear portion of the housing in the connector fitting direction.

The slider 70 comprises a first slide member 71, a second slide member 76 engaged with a rear portion of the first slide member 71, and compression springs 83 held in the second slide member 76.

The first slide member 71 includes a pair of rearwardly-extending stopper arm portions 73 and 73, which are engaged respectively with front ends of the compression springs 83, and an interconnecting portion 74 interconnecting these arm portions. An abutment portion 75, against which the pressing rib 92 on the female connector 90, can abut, is formed at the interconnecting portion 74. A pair of slide grooves 72 and 72 for allowing the movement of engagement arm portions 78 of the second slide member 76 are formed in opposite ends of the interconnecting portion 74, respectively.

The second slide member 76 has forwardly-extending retaining portions 77. The retaining portions 77 can be engaged respectively with the housing locks 68, formed respectively at the distal ends of the lock arms 66, during a connector fitting operation. A passage notch 77*a* for allowing the passage of the pressing rib 92 of the female connector 90 is formed between front ends of the retaining portions 77. An operating portion 79, which is pressed when canceling the fitting connection, is formed at an upper portion of the second slide member 76 at a widthwise-central portion thereof, and this operating portion 79 covers the pressing portion 69 of the lock arms 66 in overlying relation thereto.

For assembling the slider 70, the compression springs 83 are inserted respectively into spring receiving chambers 81 in the second slide member 76, and then the stopper arm portions 73 of the first slide member 71 are inserted into the spring receiving chambers 81, respectively. The engagement arm portions 78 are engaged respectively with retaining surfaces 73*a* of the stopper arm portions 73, thereby combining the first and second slide members 71 and 76 together into a unitary form. The slider 70, thus assembled into a unitary form, is inserted into the male connector 60 from the front side thereof, and is pushed until the rear end of the second slide member 76 is brought into retaining engagement with retaining projections 67*a* of the retaining arms 67.

The female connector 90 has a housing insertion port 94 open to the front side thereof. The pressing rib 92 for abutment against the abutment portion 75 of the first slide member 71 is formed upright on a housing 91. The pair of engagement projections 93 for respectively elastically deforming the lock arms 66 are formed respectively on both side surfaces of the pressing rib 92 at the front end thereof.

Next, the operation for fitting the male and female connectors 60 and 90 together will be described.

When the fitting operation is started as shown in FIG. 9, the pressing rib 92 of the female connector 90 passes through the passage notch 77*a* (see FIG. 8), and the front end of the pressing rib 92 abuts against the abutment portion 75 of the first slide member 71.

When the fitting operation further proceeds, the pressing rib 92 of the female connector 90, while pressing the first slide member 71, enters the insertion space 66*a* (see FIG. 8) between the lock arms 66 of the male connector 60. At this time, the engagement projections 93, formed at the front end of the pressing rib 92, are brought into sliding contact with slanting surfaces of the housing locks 68, formed respectively at the distal ends of the lock arms 66, respectively, so that the distal end portions of the lock arms 66 are displaced toward the housing 91 of the female connector 90. As a result, the distal ends of the housing locks 68 are engaged respectively with the retaining portions 77 of the second slide member 76, thereby preventing the sliding movement of the second slide member 76, as shown in FIG. 10.

When the fitting operation further proceeds, the first slide member 71 is pushed by the pressing rib 92, and therefore is moved rearward. At this time, the engagement arm portions 78 of the second slide member 76 are introduced respectively into the slide grooves 72 (see FIG. 8) in the first slide member 71. Thus, the first slide member 71 is moved while the second slide member 76 is stopped, and therefore the compression springs 83 in the second slide member 76 are compressed, and a restoring force for resiliently restoring the compression spring 83 into its original condition is produced in each compression spring 83.

If the fitting operation is stopped in a half-fitted condition in which the housing locks 68 of the male connector 60 are not completely engaged respectively with the engagement projections 93 of the female connector 90, the first slide member 71 is pushed back in a disengaging direction (opposite to the connector fitting direction) by the restoring force of the compression springs 83. Therefore, the half-fitted condition can be easily detected.

Then, when the fitting operation further proceeds against the bias of the compression springs 83, the engagement projections 93 of the female connector 90 slide respectively past the housing locks 68 formed respectively at the distal ends of the lock arms 66, as shown in FIG. 11. At this time, the lock arms 66 are elastically restored into their original shape. As a result, the engagement of the distal end of each housing lock 68 with the retaining portion 77 is canceled, so that the housing lock 68 is engaged with the rear end of the engagement projection 93. Namely, the male connector 60 and the female connector 90 are completely fitted together, and contacts 64 in the male connector are completely electrically connected respectively to contacts 95 in the female connector.

For canceling the completely-fitted condition shown in FIG. 11, the operating portion 79 of the second slide member 76 is pushed back by the finger or other against the bias of the compression springs 83 to a position where this operating portion 79 covers the pressing portion 69 of the lock arms 66. In this condition, the operating portion 79 is pressed to depress the pressing portion 69, so that the housing locks 68 of the lock arms 66 are displaced downward (in the drawings). As a result, the engagement of the housing locks 68 with the engagement projections 93 is canceled. At this time, the first slide member 71 is pushed forward by the restoring force of the compressed compression springs 83. As a result, the female connector 90 is pushed back in the disengaging direction through the pressing rib 92 abutted against the abutment portion 75 of the first slide member 71.

In the above conventional connector fitting structure 51, the slider 70 is mounted in the slider receiving portion 63 of the male connector 60, and in this condition, the restoring force is slightly produced in the compression springs 83 before the fitting operation is started. Therefore, the retainment of the second slide member 76 by the retaining projections 67*a* of the retaining arms 67 was sometimes canceled by vibrations or other developing during the transport of the product, so that the second slide member 76 is moved rearward (right in FIG. 9) by the resilient force of the compression springs 83. If the second slide member 76 is thus moved, the second slide member 76 must first be pushed back to its initial position (shown in FIG. 9) when starting the fitting operation, and therefore the fitting operation is cumbersome.

SUMMARY OF THE INVENTION

The present invention has been made under the above circumstances, and an object of the invention is to provide a connector fitting structure in which a half-fitted condition of a pair of male and female connectors can be positively detected, and besides the fitting operation can be easily carried out.

The above object of the invention has been achieved by a connector fitting structure comprising a first connector having an inner housing opening to a front side thereof, an outer housing covering the inner housing and a lock arm provided on the inner housing;

a second connector fitted and connected to the first connector and having an engagement projection;

a slider comprising, a first slide member for sliding within the connector in a connector fitting direction, a second slide member engaged with a rear portion of the first slide member, and an resilient member for urging the first and second slide members away from each other;

wherein at least one part of the second slide member is engaged with at least one part of the first connector to thereby retain the second slide member in its initial position and a stopper means provided on the fist slide member for preventing the cancellation of the engagement between the parts of the second slide member and the first connector before the connector fitting operation, and wherein, the engagement projection of the second connector urges the first slider member and deforms elastically the lock arm to thereby prevent tentatively the second slide member from moving, whereby the first slide member is moved relatively to the second slide member and the first connector to thereby unlock the stopper means and disengage the engagement between the parts of the second slide member and the first connector by an abutment of a part of the first connector to the second sliding member in accordance with the connector fitting operation.

In the above connector fitting structure, when the slider is disposed in its initial position where the second retaining portion of the second slide member is retained by the first retaining portion of the one connector before the operation for fitting the male and female connectors together is started, the stopper of the first slide member prevents the cancellation of the engagement of the first retaining portion with the second retaining portion. Therefore, the second slide member can be positively prevented from being moved before starting the fitting operation, and therefore it is not necessary to push the second slide member back to its initial position, and the fitting operation can be carried out easily and rapidly.

DETAIL DESCRIPTION OF THE PREFERRED EMBODIMENTS

Figure 1:
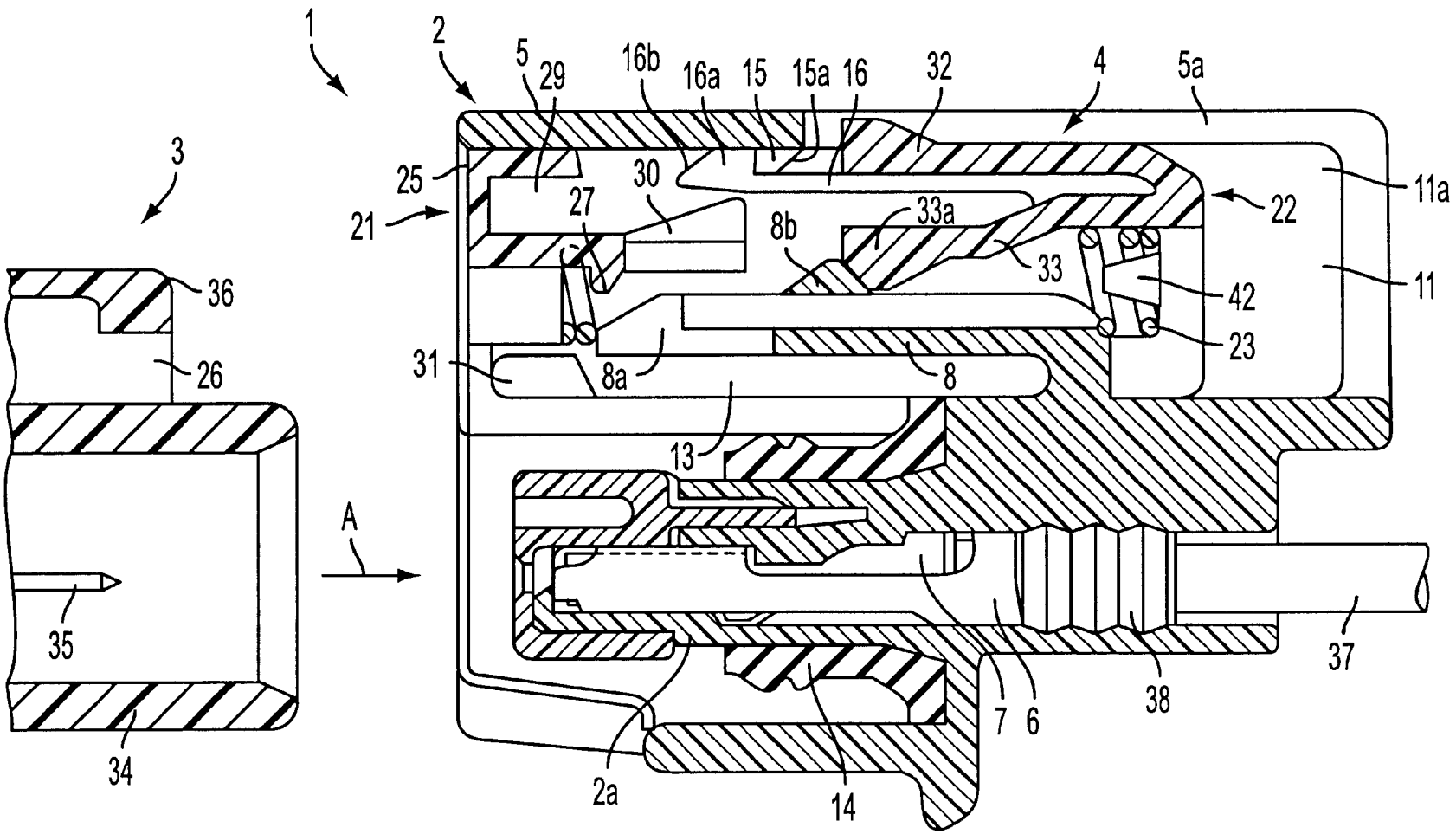
FIG. 1 is a cross-sectional view of one preferred embodiment of a connector fitting structure of the invention, showing a condition before two connectors are fitted together.
Figure 2:
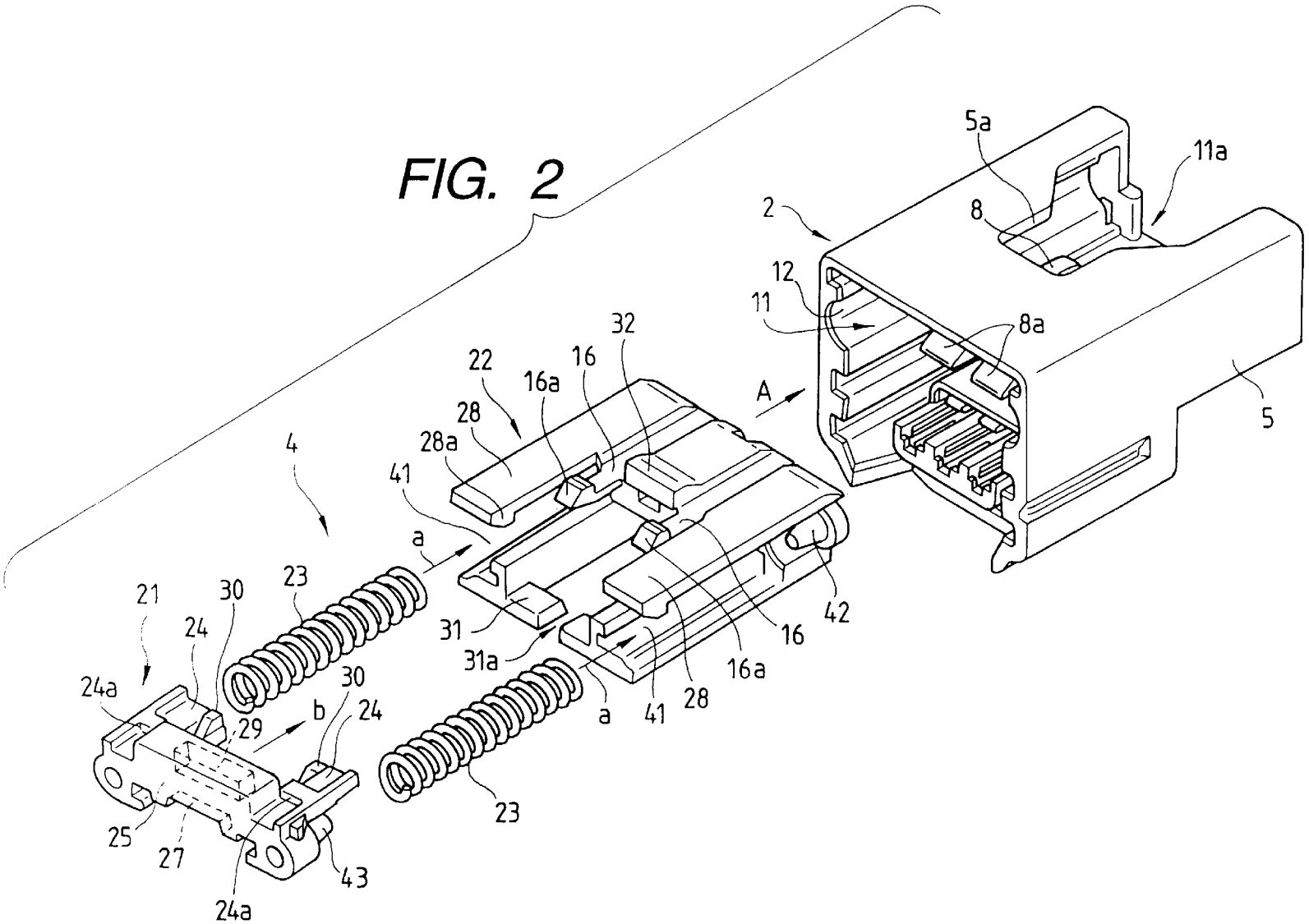
FIG. 2 is an exploded, perspective view showing the construction of a slider.
Figure 3:
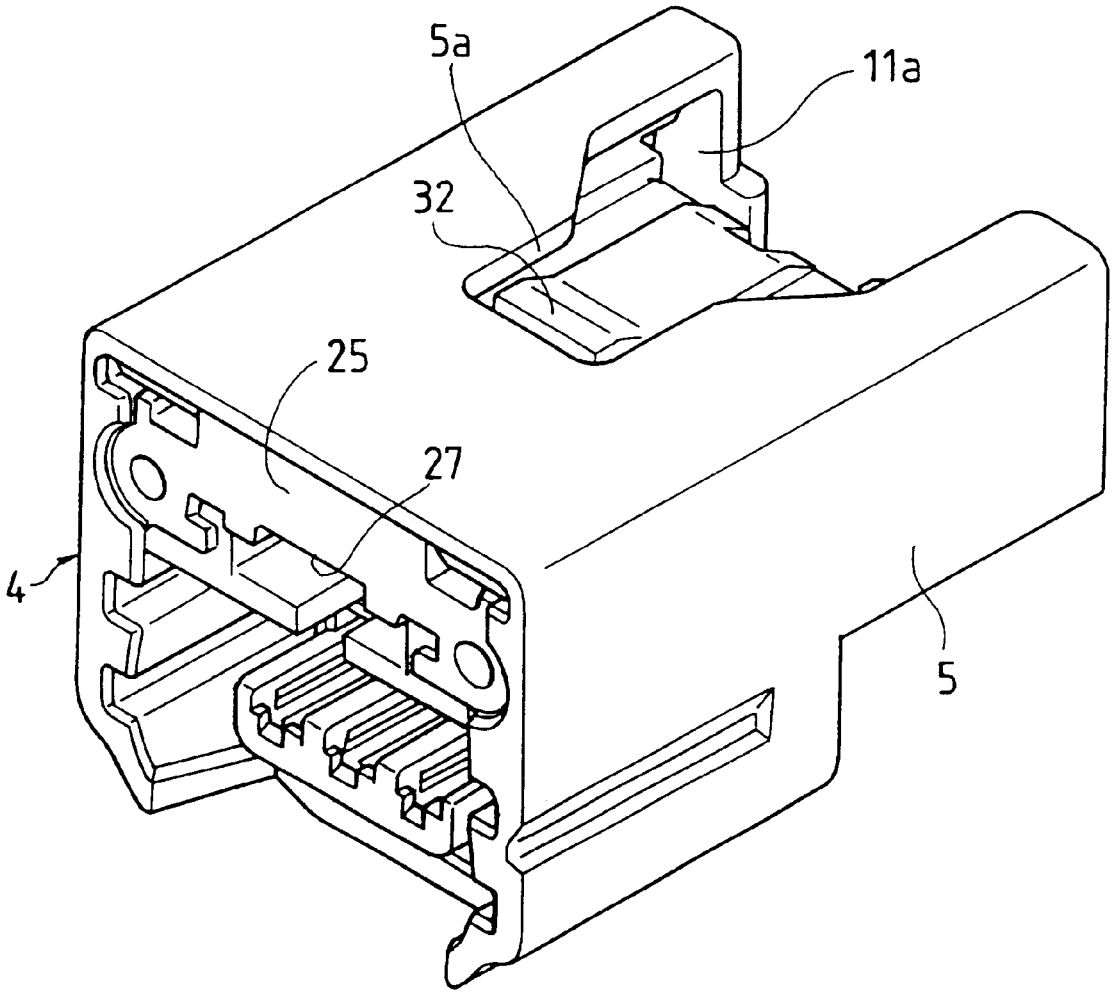
FIG. 3 is a perspective view showing a condition in which the slider is mounted in the male connector.

One preferred embodiment of the present invention will now be described in detail with reference to the drawings. FIG. 1 is a cross-sectional view of a connector fitting structure of this embodiment, showing a condition before two connectors are fitted together, FIG. 2 is an exploded, perspective view showing the construction of a slider of the connector fitting structure of FIG. 1, and FIG. 3 is a perspective view showing a condition in which the slider is mounted in the male connector of FIG. 2.

Figure 4:
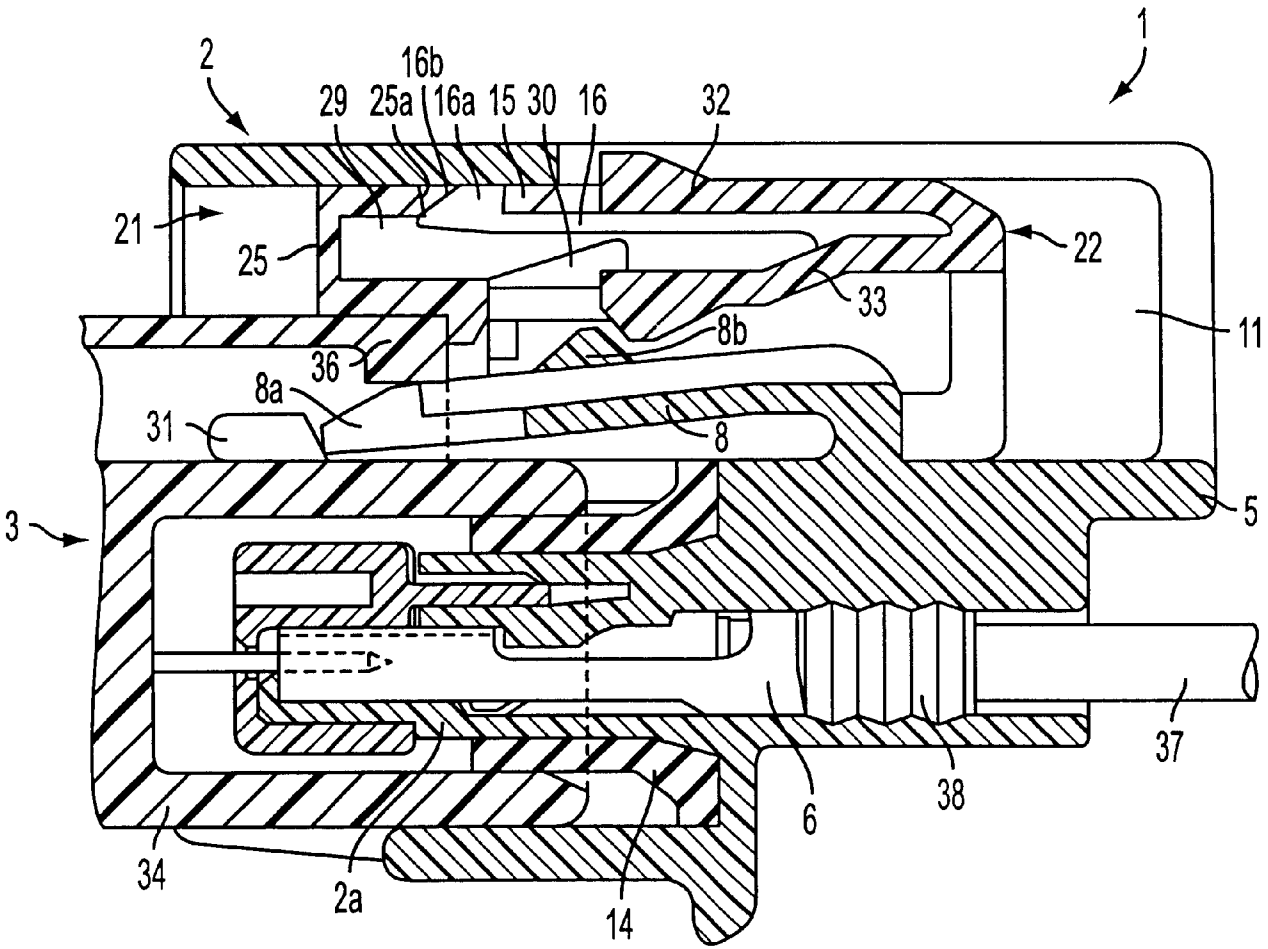
FIG. 4 is a cross-sectional view, showing a condition in which the fitting of the male and female connectors relative to each other is initiated.
Figure 5:
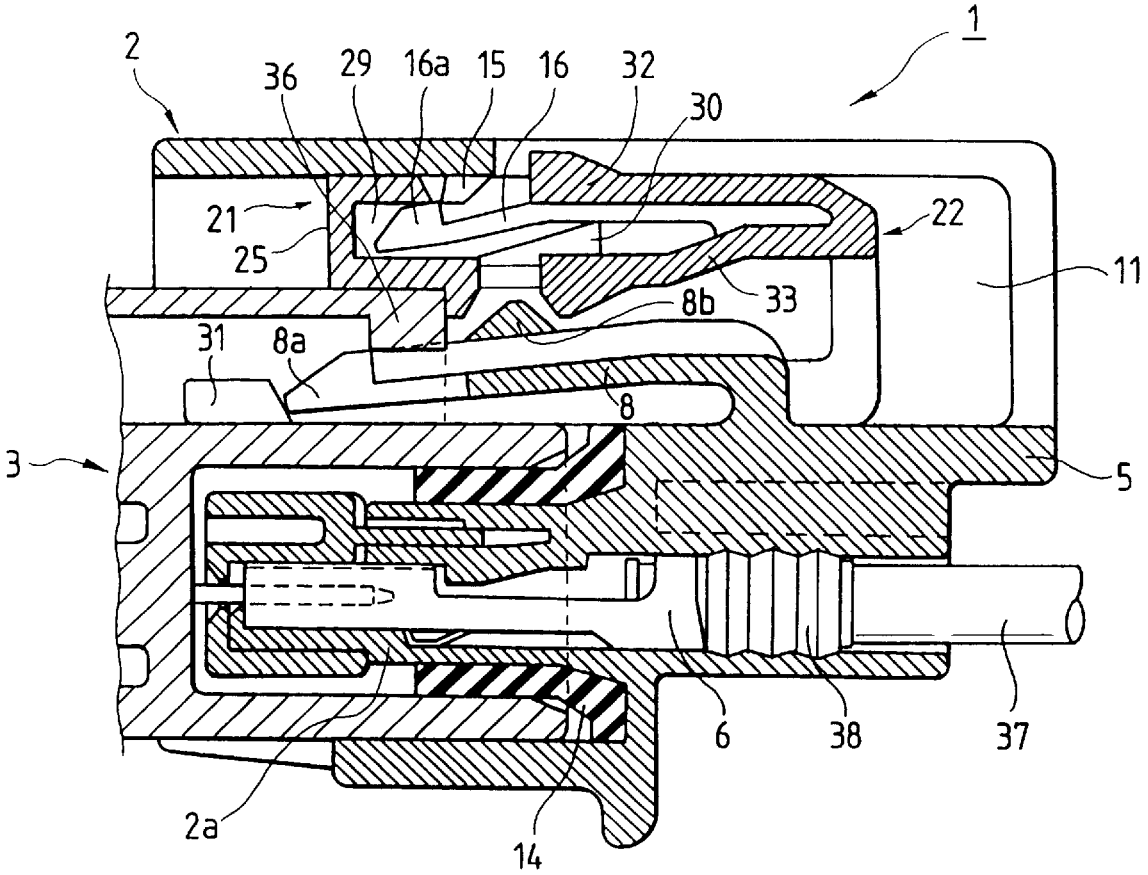
FIG. 5 is a cross-sectional view, showing a half-fitted condition of the male and female connectors.
Figure 6:
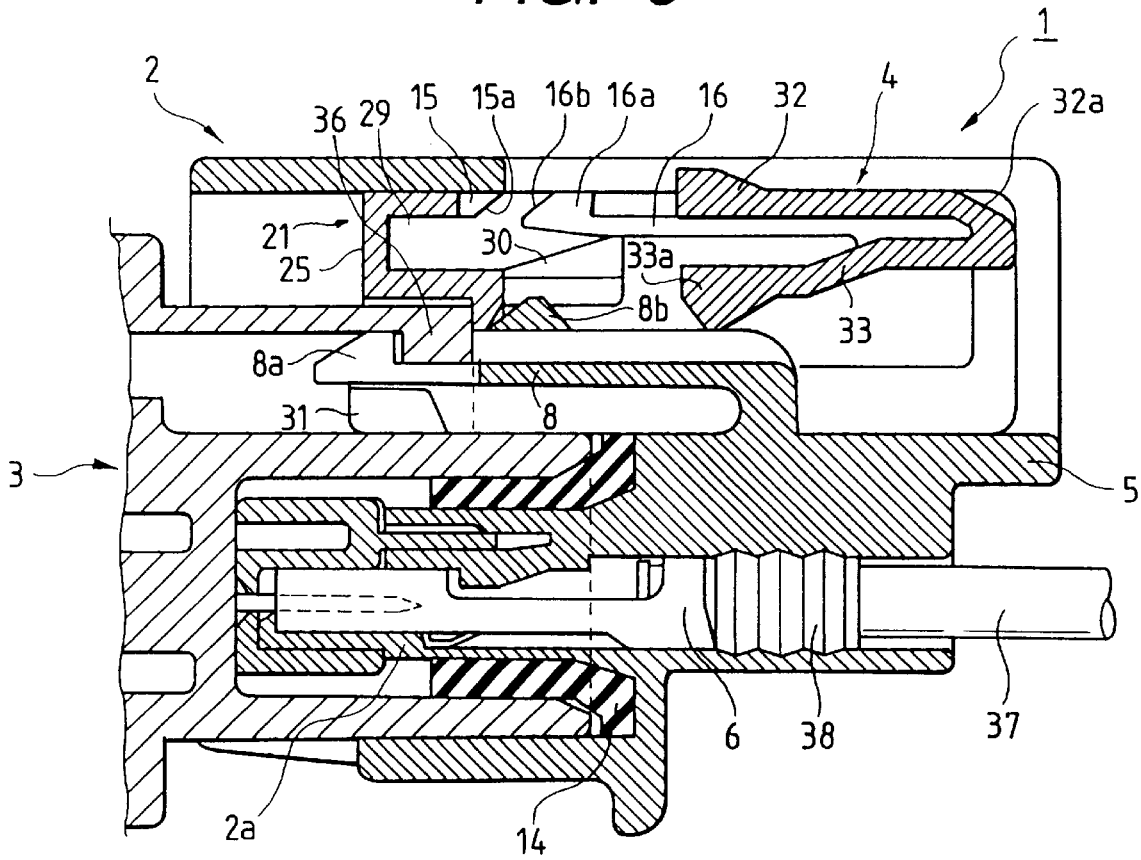
FIG. 6 is a cross-sectional view, showing a completely-fitted condition of the male and female connectors.
Figure 7:
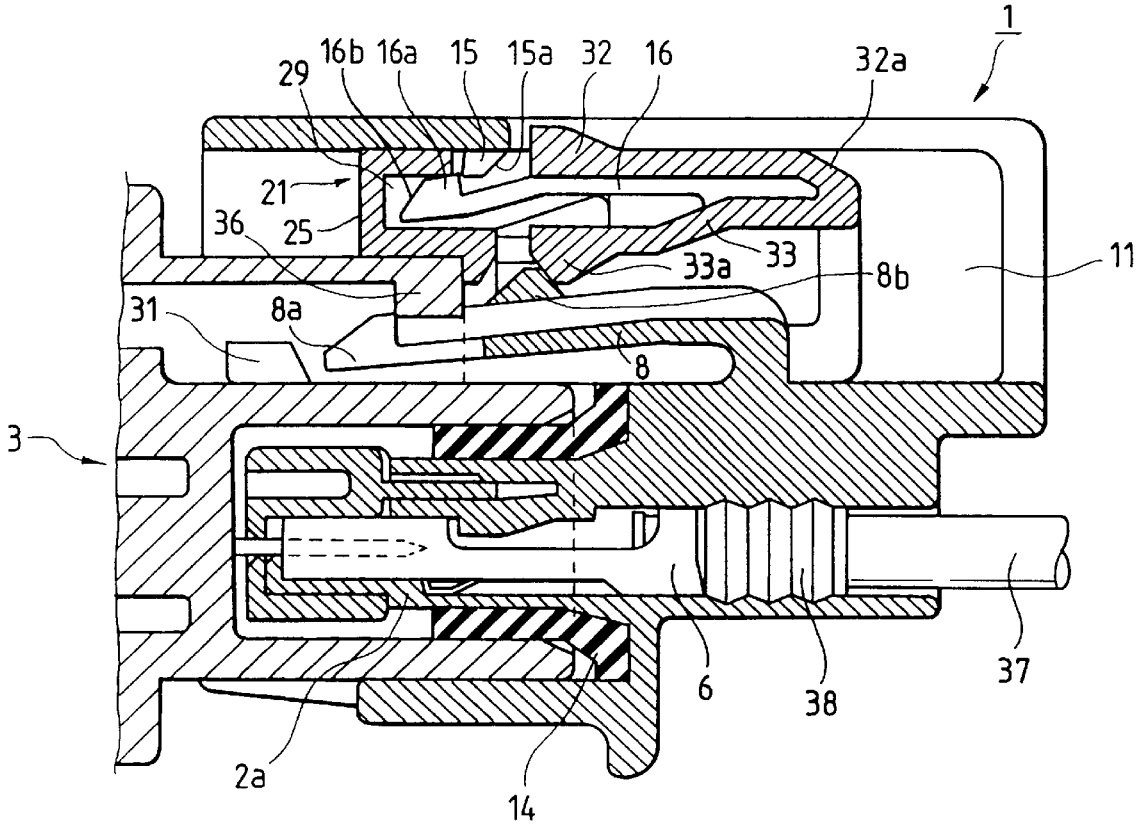
FIG. 7 is a cross-sectional view, showing a process of canceling the fitted condition of the male and female connectors.
Figure 8:
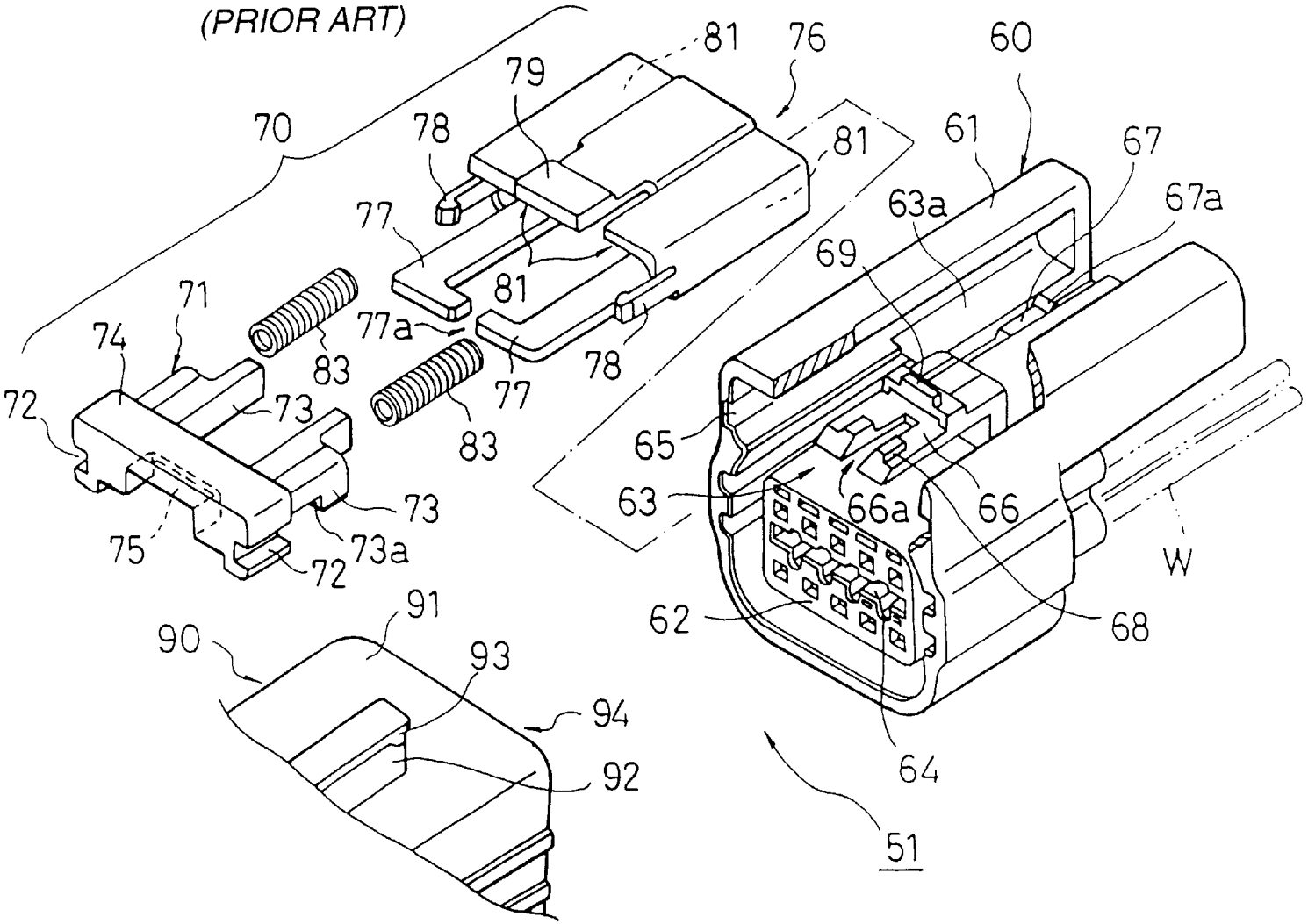
FIG. 8 (PRIOR ART)
FIG. 8 is an exploded, perspective view of a conventional connector fitting structure.
Figure 9:
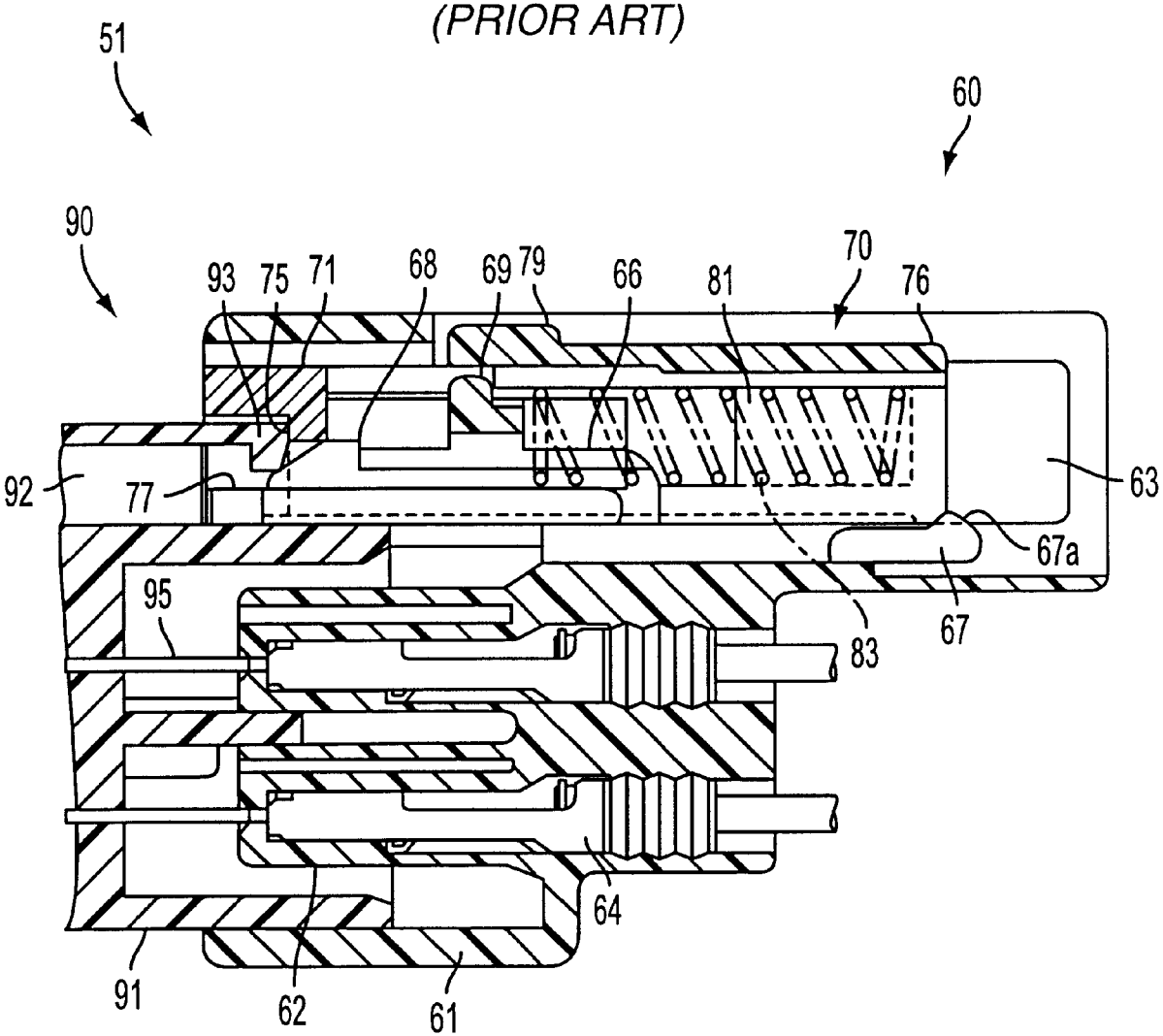
FIG. 9 (PRIOR ART)
FIG. 9 is a cross-sectional view of the conventional connector fitting structure, showing a condition before a connector fitting operation is started.
Figure 10:
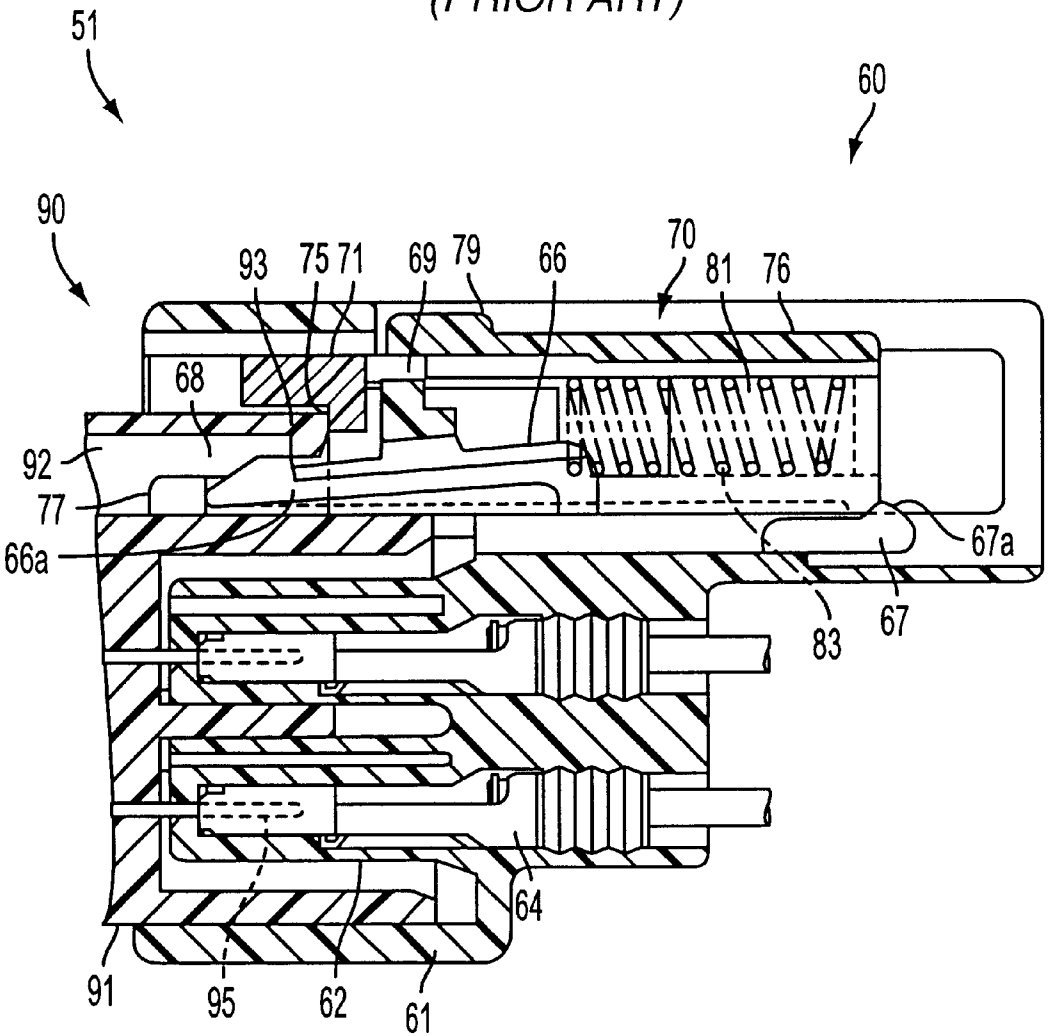
FIG. 10 (PRIOR ART)
FIG. 10 is a cross-sectional view of the connector fitting structure of FIG. 9, showing a half-fitted condition.
Figure 11:
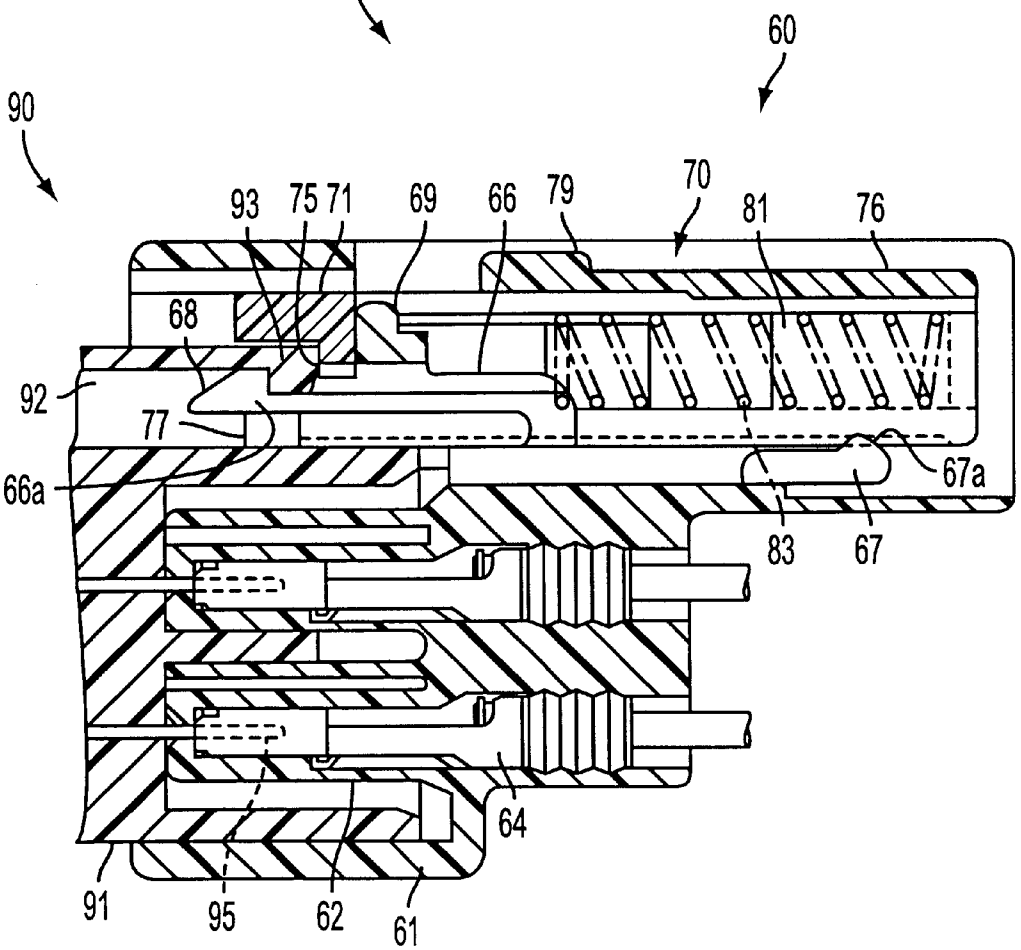
FIG. 11 (PRIOR ART)
FIG. 11 is a cross-sectional view of the connector fitting structure of FIG. 9, showing a completely-fitted condition.

FIG. 4 is a cross-sectional view of the connector fitting structure of FIG. 1, showing a condition in which the fitting of the connectors relative to each other is initiated, FIG. 5 is a cross-sectional view of the connector fitting structure of FIG. 1, showing a half-fitted condition of the connectors, FIG. 6 is a cross-sectional view of the connector fitting structure of FIG. 1, showing a completely-fitted condition of the connectors, and FIG. 7 is a cross-sectional view of the connector fitting structure of FIG. 1, showing a process of canceling the fitted condition of the connectors.

As shown in FIG. 1, the connector fitting structure 1 comprises the male connector (one connector) 2, the female connector (the other connector) 3, and the slider 4.

The male connector 2 includes an inner housing 2*a,* which has terminal receiving chambers 7 for respectively receiving a predetermined number of socket contacts 6, and is open to the front side thereof, and a hood-like outer housing 5 covering the inner housing 2*a*. A slider receiving portion 11 is formed between an inner surface of the outer housing 5 and a surface (an upper surface of an upper wall in the drawings) of the inner housing 2*a*. Lock arms 8, each having a free end (front end in a connector fitting direction), are formed integrally on the upper surface of the inner housing 2*a* in a cantilever manner. A housing lock 8*a* is formed on an upper surface of each lock arm 8 at a distal end thereof. A pressing portion 8*b* is formed on central portions of the lock arms 8. An insertion space 13 is formed between the lower surfaces of the lock arms 8 and the upper surface of the inner housing 2*a*. A seal member 14 is fitted on the outer periphery of the inner housing 2*a*.

First retaining portions 15, each in the form of a projection or a hook, are formed on the inner surface (a lower surface of an upper wall in the drawings) of the outer housing 5. These first retaining portions 15 are engaged with second retaining portions 16*a* of the slider 4 (described later), respectively.

As shown in FIG. 2, the slider 4 comprises a first slide member 21 for sliding movement in a connector fitting direction within the outer housing 5, and a second slide member 22 engaged with a rear portion (in the connector fitting direction) of the first slide member 21. The slider 4 further comprises compression springs (resilient members) 23 and 23 urging the first and second slide members 21 and 22 away from each other.

The first slide member 21 includes a pair of rearwardly-extending stopper arm portions 24 and 24, and an interconnecting portion 25 interconnecting these stopper arm portions 24 and 24 at front ends (in the connector fitting direction) thereof. An abutment portion 27 is formed at that surface (lower surface in the drawings) of the interconnecting portion 25 which faces the inner housing when the slider is mounted in the outer housing 5, the abutment portion 27 being disposed immediately adjacent to the front end of the interconnecting portion 25. A slide groove 29 is formed in the lower surface (in the drawings) of the rear end portion of the interconnecting portion 25, and this slide groove 29 prevents the second slide member 22 from interfering with the interconnecting portion 25 when the first and second slide members 21 and 22 approach each other during the fitting operation. An auxiliary retaining surface 24*a* is formed on an upper surface (in the drawings) of each stopper arm portion 24, and a stopper projection (stopper) 30 is formed on the upper surface (in the drawings) of the stopper arm portion 24 at a rear end thereof. A retaining projection 43, which retains the front end of the compression spring 23, is formed at a lower portion (in the drawings) of each stopper arm portion 24.

The second slide member 22 has forwardly-extending retaining portions 31. The retaining portion 31 can be engaged respectively with the housing locks 8*a* during the connector fitting operation. A passage notch 31*a* is formed between front ends of the retaining portions 31. An operating portion 32 is formed at that side (upper side in the drawings) of the second slide member 22 which faces an operating notch 5*a* in the outer housing 5 when the slider is mounted in the outer housing 5. A pair of forwardly-extending auxiliary arms 28 and 28 are formed at the upper side (in the drawings) of the second slide member 22. An auxiliary retaining projection 28*a* for retaining engagement with the corresponding auxiliary retaining surface 24*a* of the first side member 21 is formed at a distal end of each auxiliary arm 28.

A pair of forwardly-extending first engagement arms 16 and 16 are formed at the upper side (in the drawings) of the second slide member 22. The second retaining portion 16*a* in the form of a projection or a hook is formed on an upper surface (in the drawings) of each first engagement arm 16 at a distal end thereof.

The operating notch 5*a* is formed in the upper wall (in the drawings) of the outer housing 5 of the male connector 2, and the operating portion 32 can be operated from the exterior through this operating notch 5*a*. Guide grooves 12 for respectively guiding opposite side portions of the slider 4 are formed respectively in inner surfaces of opposite side walls of the outer housing 5. Within the slider receiving portion 11, a side space 11*a* is formed between each lock arm 8 and the inner surface of the outer housing 5.

For assembling the slider 4, the compression springs 23 are inserted respectively into fitting grooves 41, formed respectively in the opposite side portions of the second slide member 22, in a direction of arrow a (in the drawings), and one ends of these compression springs 23 are held respectively by retaining projections 42 formed respectively at inner ends of the fitting grooves 41. In this condition, the first slide member 21 is moved toward the second slide member 22 in a direction of arrow (in the drawings), and the retaining projections 43 of the first slide member 21 are inserted into the other ends of the compression springs 23, respectively. Then, the auxiliary retaining projections 28 of the second slide member 22 are retainingly engaged respectively with the auxiliary retaining surfaces 24*a* of the first slide member 21, thereby combining the first and second slide members 21 and 22 together into a unitary form so that the first and second slide members 21 and 22 can move toward and away from each other along the connecting fitting direction.

When the assembled slider 4 is moved in a direction of arrow A (in the drawings), and is inserted into the slider receiving portion 11 of the male connector 2, the operating portion 32 is brought into contact with the inner surface of the upper wall of the outer housing 5 to be deformed downwardly (in the drawings), and further slides on this inner surface in this deformed condition. Then, when the operating portion 32 reaches the operating notch 5*a,* this operating portion 32 is elastically restored into its original shape. Therefore, whether or not the slider 4 has been properly mounted in the outer housing can be confirmed from the condition of the operating portion 32.

When the slider 4 is completely mounted in the outer housing 5 as shown in FIG. 3, the operating portion 32 is exposed to the exterior through the operating notch 5*a*. Also, the interconnecting portion 25 of the first slide member 21 and the abutment portion 27 are exposed to the front side of the outer housing 5.

Referring back to FIG. 1, when the slider 4 is mounted in the slider receiving portion 11, the first retaining portions 15 of the outer housing 5 are engaged respectively with the second retaining portions 16*a* of the second slide member 22, thereby preventing the second slide member 22 from moving toward the rear end (right end in the drawings) of the slider receiving portion 11. Each stopper projection 30 of the first slide member 21 supports that portion of a lower surface (in the drawings) of the corresponding first engagement arm 16 (of the second slide member 22) facing away from the second retaining portion 16*a,* thereby preventing the engagement of the first retaining portion 15 with the second retaining portion 16*a* from being accidentally canceled. Here, the stopper projection 30 abuts against that portion of the first engagement arm 16 disposed in the vicinity of an extension line of the area of engagement between the first retaining portion 15 and the second retaining portion 16*a*.

The second slide member 22 has a second engagement arm 33 of an elastic nature formed below (in the drawings) the operating portion 32. The second engagement arm 33 serves to prevent the withdrawal of the slider 4 mounted in the slider receiving portion 11, and has a third retaining portion 33*a* formed at a distal end thereof. The third retaining portion 33*a* is abutted against the pressing portion 8*b,* thereby preventing the withdrawal of the slider 4.

The female connector (the other connector) 3 includes a housing 34 into which pin contacts 35 project in the connecting fitting direction. A plate-like pressing rib 26 for abutment against the abutment portion 27 of the first slide member 21 is formed upright on the housing 34, and extends in the connector fitting direction. Engagement projections 36 are formed respectively on both sides of the pressing rib 26 at a front end thereof.

Next, the operation for fitting the male and female connectors 2 and 3 together will be described.

When the fitting operation is initiated in the condition shown in FIG. 1, the pressing rib 26 of the female connector 3 passes through the passage notch 31*a* (see FIG. 2) in the second slide member, and the front end of the pressing rib 26 abuts against the abutment portion 27 of the first slide member 21. When, the fitting operation further proceeds, the pressing rib 26 pushes the first slide member 21 toward the rear end of the slider receiving portion 11. At this time, the stopper projections 30 of the first slide member 21 are also moved toward the rear end of the slider receiving portion 11, and therefore each stopper projection 30 ceases to support that portion of the lower surface (in the drawings) of the corresponding first engagement arm 16 (of the second slide member 22) facing away from the second retaining portion 16*a,* as shown in FIG. 4.

Also, at this time, the engagement projections 36, formed at the front end of the pressing rib 26, are brought into sliding contact with slanting surfaces of the housing locks 8*a,* formed respectively at the distal ends of the lock arms 8, respectively, so that the distal end portions of the lock arms 8 are elastically deformed toward the housing 34 of the female connector 3 (that is, downwardly in the drawings). As a result, the retaining portions 31 of the second slide member 22 are engaged respectively with the distal ends of the housing locks 8, thereby preventing the second slide member 22 from moving toward the rear end of the slider receiving portion 11, as shown in FIG. 4. On the other hand, the first slide member 21 is pushed toward the rear end of the slider receiving portion 11. Thus, the first slide member 21 is moved while the second slide member 22 is stopped, and therefore the compression springs 23 (see FIG. 1) in the second slide member 22 are compressed, and a restoring force for resiliently restoring the compression spring 23 into its original condition is produced in each compression spring 23. If the fitting operation is stopped in a half-fitted condition, the first slide member 21 and the female connector 3 are pushed back in a disengaging direction (opposite to the fitting direction) by the restoring force of the compression springs 23. Therefore, the half-fitted condition can be easily detected.

Then, when the fitting operation further proceeds, a rear end 25*a* (serving as engagement canceling means) of an upper wall of the interconnecting portion 25 of the first slide member 21 slides over slanting surfaces 16*b* formed respectively at the front ends of the second retaining portions 16*a*. As a result, the distal end portions of the first engagement arms 16 are elastically deformed downwardly as shown in FIG. 5, and the second retaining portions 16*a* are inserted into the slide groove 29. Then, the engagement of each second retaining portion 16*a* with the corresponding first retaining portion 15 is canceled.

When the fitting operation further proceeds, the engagement projections 36 slide respectively past the housing locks 8*a,* so that the lock arms 8 are elastically restored into their original shape, as shown in FIG. 6. As a result, the engagement of the distal end of each housing lock 8*a* with the retaining portion 31 is canceled, so that the housing lock 8*a* is engaged with the rear end of the engagement projection 36. Also, the engagement of each first retaining portion 15 with the corresponding second retaining portion 16*a* is completely canceled, so that the whole of the slider 4 is moved toward the rear end of the slider receiving portion 11 by the restoring force of the compression springs 23. As a result, the male connector 2 and the female connector 3 are completely fitted together, and the contacts in the male connector are completely electrically connected respectively to the contacts in the female connector.

Next, the operation for canceling the fitted condition of the male and female connectors 2 and 3 will be described.

For canceling the fitted condition, the operating portion 32, shown in FIG. 6, is pushed toward the front end (left end in the drawings) of the slider receiving portion 11 by the finger or other against the bias of the compression springs 23. As a result, the slanting slide surface 16*b* of each second retaining portion 16*a* slides on a similarly-slanting slide surface 15*a* of the corresponding first retaining portion 15. At this time, each first engagement arm 16 of the second slide member 22 is easily elastically deformed since that portion of the lower surface (in the drawings) of the first engagement arm 16, facing away from the second retaining portion 16*a,* is not supported by the stopper projection 30, and therefore the second retaining portion 16*a* slides past the first retaining portion 15, as shown in FIG. 7. Also, the third retaining portion 33*a* of the second engagement arm 33 slides over the pressing portion 8*b* of the lock arms 8, so that the lock arms 8 are elastically deformed downwardly (in the drawings), and therefore the engagement of the housing lock 8*a* (formed at the distal end of each lock arm 8) with the corresponding engagement projection 36 is canceled. At this time, the first slide member 21 is pushed back toward the front end of the slider receiving portion 11 by the restoring force of the compressed compression springs 23. As a result, the female connector 3 is pushed back in the disengaging direction.

In the connector fitting structure 1, when the slider 4 is disposed in its initial position where the second retaining portions 16*a* of the second slide member 22 are retained respectively by the first retaining portions 15 of the male connector 2 before the operation for fitting the male and female connectors 2 and 3 together is started, each stopper projection 30 of the first slide member 21 prevents the cancellation of the engagement of the first retaining portion 15 with the second retaining portion 16*a*. Therefore, the second slide member 22 can be positively prevented from being moved by vibrations or other before starting the fitting operation, and therefore it is not necessary to push the second slide member 22 back to its initial position, and the fitting operation can be carried out easily and rapidly.

When canceling the fitted condition, each first engagement arm 16 of the second slide member 22 is easily elastically deformed since that portion of the lower surface of the first engagement arm 16, facing away from the second retaining portion 16*a,* is not supported by the stopper projection 30, and the engagement of each first retaining portion 15 with the second retaining portion 16*a* can be smoothly canceled. Therefore, the operation for canceling the fitted condition can be effected easily.

The present invention is not limited to the above embodiment, but suitable modifications and improvements can be made.

For example, in the above embodiment, although the stoppers are defined by the projections (stopper projections) 30, respectively, these stoppers may have any other suitable form in so far as they perform a stopper function. Although the slider 4 is received in the male connector 2, it can be received in the female connector 3. Although there are provided the two lock arms 8 and the two first engagement arms 16, there may be provided one lock arm and one first engagement arm.

As described above, in the present invention, when the slider is disposed in its initial position that the second retaining portions of the second slide member are retained respectively by the first retaining portions of the one connector before the operation for fitting the male and female connectors together is started, each stopper of the first slide member prevents the cancellation of the engagement of the first retaining portion with the second retaining portion. Therefore, the second slide member can be positively prevented from being moved by vibrations or other before starting the fitting operation, and therefore it is not necessary to push the second slide member back to its initial position, and the fitting operation can be carried out easily and rapidly.

What is claimed is:

1. A connector fitting structure comprising:

a first connector having an inner housing opening to a front side thereof, an outer housing covering said inner housing and a lock arm provided on said inner housing;

a second connector fitted and connected to said first connector and having an engagement projection;

a slider comprising, a first slide member for sliding within said first connector in a connector fitting direction, a second slide member engaged with a rear portion of said first slide member, and a resilient member for urging said first and second slide members away from each other;

wherein (i) before a connector fitting operation, at least one part 16*a* of said second slide member is engaged with at least one part of said first connector to thereby retain said second slide member in its initial position and a stopper means is provided on said first slide member for preventing the cancellation of the engagement between said parts of said second slide member and said first connector, and (ii) in accordance with the connector fitting operation, said engagement projection of said second connector urges said first slider member and deforms elastically said lock arm to thereby prevent tentatively said second slide member from moving, whereby said first slide member is moved relatively to said second slide member and said first connector to thereby unlock said stopper means and disengage said engagement between said parts of said second slide member and said first connector by an abutment of a portion of said first connector with said second sliding member.

2. A connector fitting structure according to claim 1, wherein said stopper means is provided as a projection.

3. A connector fitting structure according to claim 1, wherein said part of said second slide member is provided as a retaining portion formed on an elastically-deformable engagement arm provided in said second slide member and said part of said first connector is provided as a retaining portion formed on said outer housing.

4. A connector fitting structure according to claim 1, wherein said part of said first connector includes a projection provided on an inner surface of said outer housing.

5. A connector fitting structure according to claim 1, wherein in said initial position said resilient member is compressed by said first and second slide members.

6. A connector fitting structure according to claim 1, wherein said part of said second slide member includes a retaining projection formed on a deformable engagement arm and wherein said stopper means abuts against said deformable engagement arm.

7. A connector fitting structure according to claim 6, wherein stopper means includes a projection.

* * * * *